United States Patent [19]

Ganssle et al.

[11] Patent Number: 4,572,926

[45] Date of Patent: Feb. 25, 1986

[54] ARMORED ELECTRICAL CABLE WITH LEAD SHEATH

[75] Inventors: Robert Ganssle, Huntington; Ernest G. Hoffman, Middlefield; David H. Neuroth, Bethany, all of Conn.

[73] Assignee: Harvey Hubbell Incorporated, Orange, Conn.

[21] Appl. No.: 656,982

[22] Filed: Oct. 2, 1984

[51] Int. Cl.[4] ..... H01B 7/18

[52] U.S. Cl. ..... 174/103; 174/102 SP; 174/106 R; 174/109; 174/117 F; 174/121 AR

[58] Field of Search ..... 174/103, 102 SP, 105 R, 174/106 R, 108, 109, 117 F, 121 R, 121 AR, 121 SR

[56] References Cited

U.S. PATENT DOCUMENTS

| | | | |
|---|---|---|---|
| 2,544,233 | 3/1951 | Kennedy | 174/117 R |
| 2,690,984 | 10/1954 | Crandall et al. | 174/121 R |
| 2,930,837 | 3/1960 | Thompson | 174/121 R |
| 3,236,939 | 2/1966 | Blewis et al. | 174/116 |
| 3,299,202 | 1/1967 | Brown | 174/121 R |
| 3,602,636 | 8/1971 | Evans | 174/115 |
| 3,649,744 | 3/1972 | Coleman | 174/107 |
| 3,684,644 | 8/1972 | Snell | 156/53 |
| 4,096,351 | 6/1978 | Wargin et al. | 174/102 R |
| 4,284,841 | 8/1981 | Tijunelis et al. | 174/103 |
| 4,409,431 | 10/1983 | Neuroth | 174/103 |
| 4,453,035 | 6/1984 | Neuroth | 174/103 |
| 4,454,378 | 6/1984 | Neuroth | 174/103 |
| 4,490,577 | 12/1984 | Neuroth | 174/103 |

FOREIGN PATENT DOCUMENTS 0066910 12/1982 European Pat. Off. .

OTHER PUBLICATIONS

The Condensed Chemical Dictionary; Hawley, G. G.; Tenth Edition; Van Nostrand Reinhold Company; pp. 902 and 1091.

*Primary Examiner*—A. T. Grimley
*Assistant Examiner*—Morris H. Nimmo
*Attorney, Agent, or Firm*—Jerry M. Presson; Alfred N. Goodman

[57] ABSTRACT

An armored electrical cable which is especially useful in oil wells and provides resistance to corrosion, explosive decompression and transverse compressive forces. The cable comprises an insulated conductor, a barrier layer enclosing the insulation, a filler layer enclosing the barrier layer, and a square compression-resistant layer enclosing the filler layer. The barrier layer is a lead sheath having a closed cross section with an exterior including four right angle corners oriented in a square and four convex areas, each interconnecting a pair of adjacent right angle corners. The filler layer comprises a thermosetting tape, an open-mesh fabric tape, and a polymeric tape of low frictional coefficient.

21 Claims, 6 Drawing Figures

ARMORED ELECTRICAL CABLE WITH LEAD SHEATH

FIELD OF THE INVENTION

The invention relates to armored electrical cable which is especially useful in oil wells. The cable includes a lead sheath enclosing an insulated conductor to provide resistance to corrosion and a pair of U-shaped struts enclosing the lead sheath to provide resistance to transverse compressive forces. A filler layer of thermosetting material and an open-mesh fabric is interposed between the lead sheath and struts to provide a uniform and continuous containment and to resist explosive decompression in the event the insulation absorbs high pressure gas.

BACKGROUND OF THE INVENTION

Electrical cable used to power down-hole apparatus, such as pumps, in oil wells operate in an extremely hazardous environment. For example, they are constantly subjected to extreme heat, corrosive chemicals, crushing forces, and the possibility of explosive decompression upon removal from the well.

Several prior art patents have addressed this problem including U.S. Pat. Nos. 4,409,431 and 4,453,035 to Neuroth, and disclose structures providing significant protection to the conductors located inside the cables. In U.S. Pat. No. 4,409,431, a plurality of conductors are aligned in a row with substantially I-beam shaped metallic struts being located in between, the entire assembly being covered by an armor tape. In U.S. Pat. No. 4,453,035, a similar construction is provided except that each of the I-beams is formed by two U-shaped struts, each having a lead insert therein. The disclosures of these two patents are hereby incorporated by reference.

While these patents provide significant protection to crushing forces, they do not provide an impervious layer to resist corrosive chemicals. In addition, the use of the lead inserts complicates manufacturing, and the lead inserts are somewhat thin in certain areas.

U.S. Pat. No. 2,690,984 to Crandall et al also attempts to address this problem by providing a cylindrical lead barrier around an insulated conductor; however, this patent does not disclose significant resistance to compressive forces.

Thus, there is a continuing need for improvement in the field of electrical cable used in, for example, oil wells.

SUMMARY OF THE INVENTION

Accordingly, a primary object of the invention is to provide an armored electrical cable that has significant resistance to corrosion as well as resistance to crushing forces.

Another object of the invention is to provide such an electrical cable that has a chemically resistant barrier layer with adequately thick walls to provide mechanical strength and significant protection to the underlying conductor.

Another object of the invention is to provide such an electrical cable that uses a minimum number of parts to simplify manufacture.

Another object of the invention is to provide such an electrical cable that resists explosive decompression by providing a fabric layer therein in combination with a compression-resistant metallic layer.

The foregoing objects are basically attained by providing an armored electrical cable, the combination comprising: an electrical conductor; and insulation layer enclosing the conductor; a barrier layer enclosing the insulation layer, this barrier layer having a continuous cross section including an interior which is substantially circular and an exterior which includes four right angle corners oriented in a square array and four convex areas, each convex area interconnecting a pair of adjacent right angle corners; a filler layer enclosing the barrier layer; and a compression-resistant layer enclosing the filler layer and having a substantially square cross section.

Advantageously, the barrier layer is a lead sheath, the filler layer comprises a tape of thermosetting material in combination with an open-mesh fabric, and the compression-resistant layer comprises a pair of U-shaped metallic struts.

Other objects, advantages and salient features of the invention will become apparent from the following detailed description, which, taken in conjunction with the annexed drawings, discloses a preferred embodiment of the invention.

DRAWINGS

Referring now to the drawings which form a part of this original disclosure:

Figure 1:
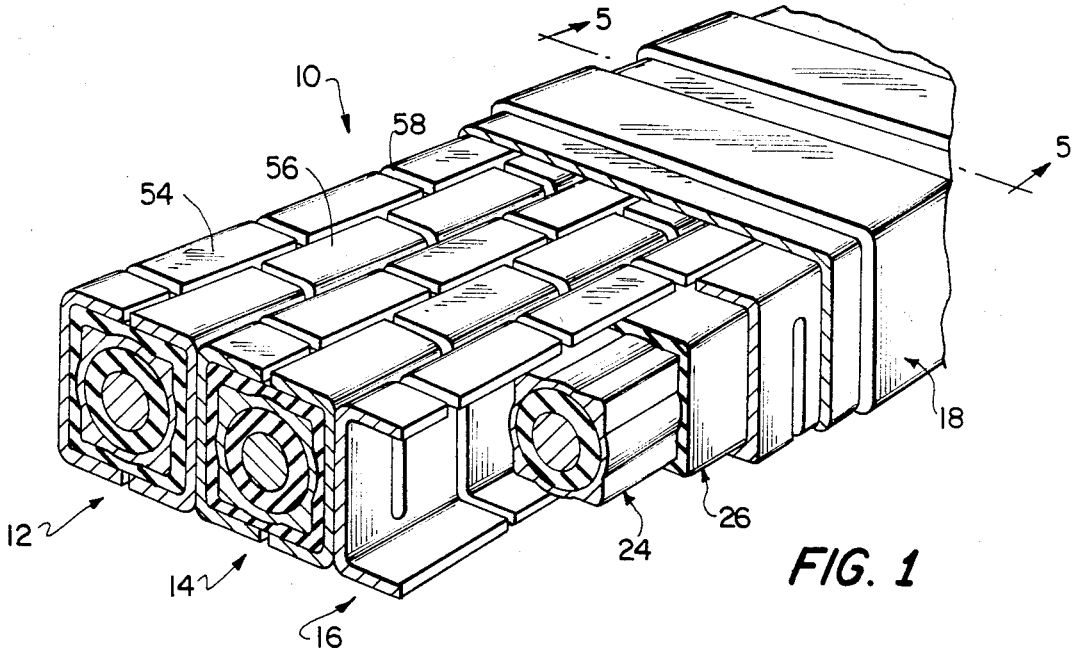
FIG. 1 is a right perspective view in partial section of the armored electrical cable in accordance with the invention.
Figure 5:
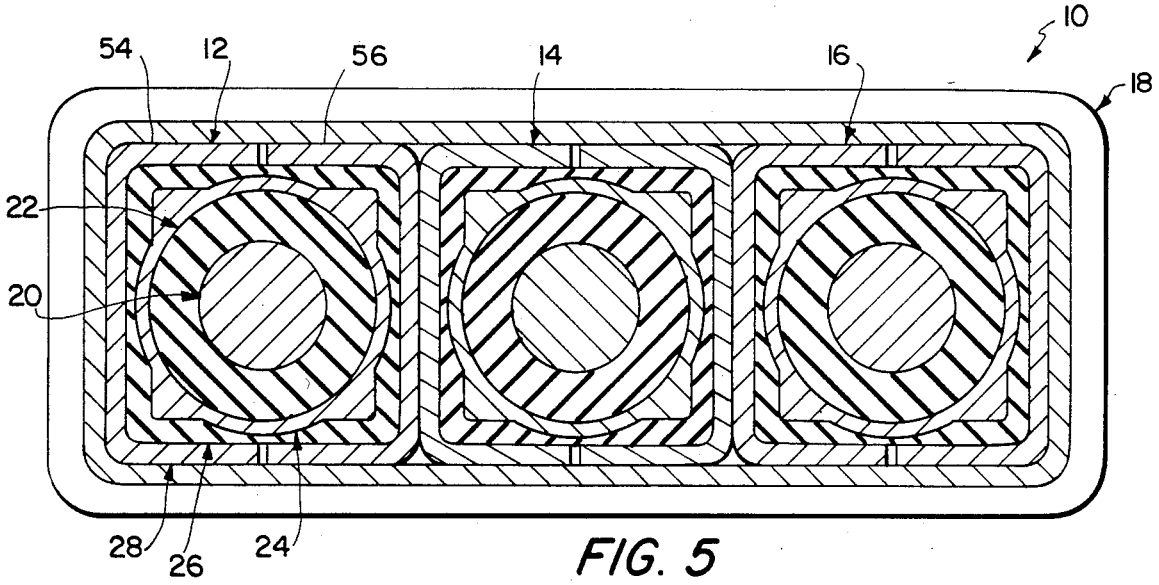
Figure 6:
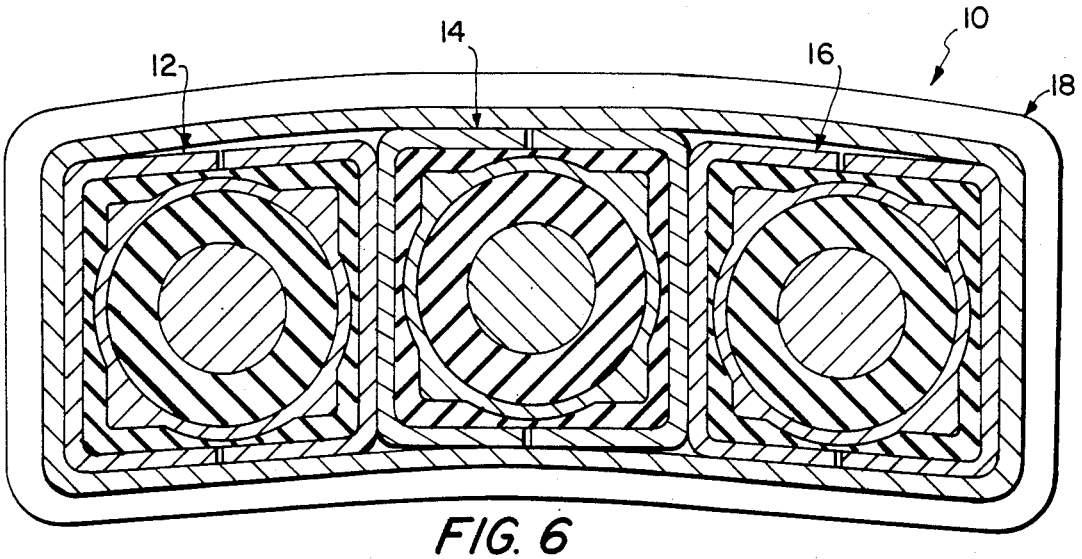

FIG. 5 is an enlarged end elevational view in transverse cross-section taken along line 5—5 in FIG. 1 of the armored electrical cable with some of the details of the filler layer being deleted for clarity; and FIG. 6 is an end elevational view in cross-section similar to that shown in FIG. 5 except that the cable has been forced through forming dies to change the rectangular cross section to a curved cross section.

DETAILED DESCRIPTION OF THE INVENTION

As seen in FIGS. 1 and 5, the armored electrical cable 10 in accordance with the invention comprises three conductor assemblies 12, 14 and 16 in a side-by-side, engaging relationship and an armor tape 18 enclosing the three conductor assemblies. Each conductor assembly comprises a conductor 20, an insulation layer 22, a barrier layer 24 to resist corrosion, a filler layer 26, and a compression-resistant layer 28, these last two layers in conjunction providing a uniform containment to resist explosive decompressive forces and externally generated and inwardly directed compressive forces.

Figure 2:
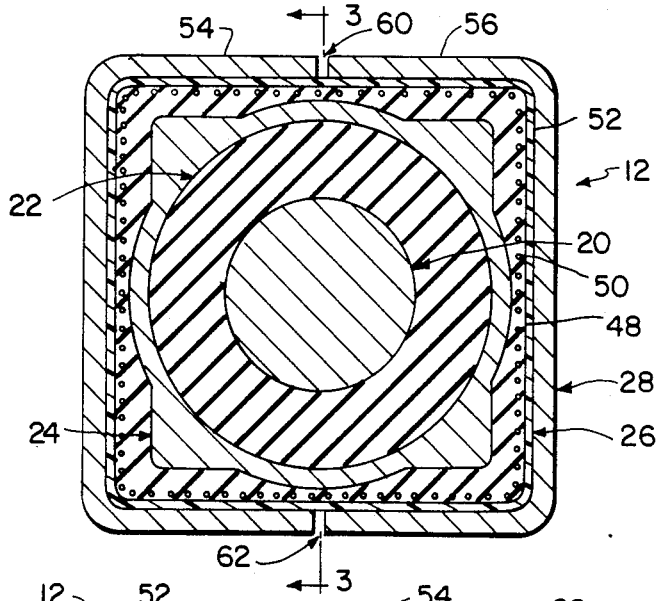
FIG. 2 is an enlarged end elevational view in transverse cross-section of one of the conductor assemblies shown in FIG. 1.
Figure 3:
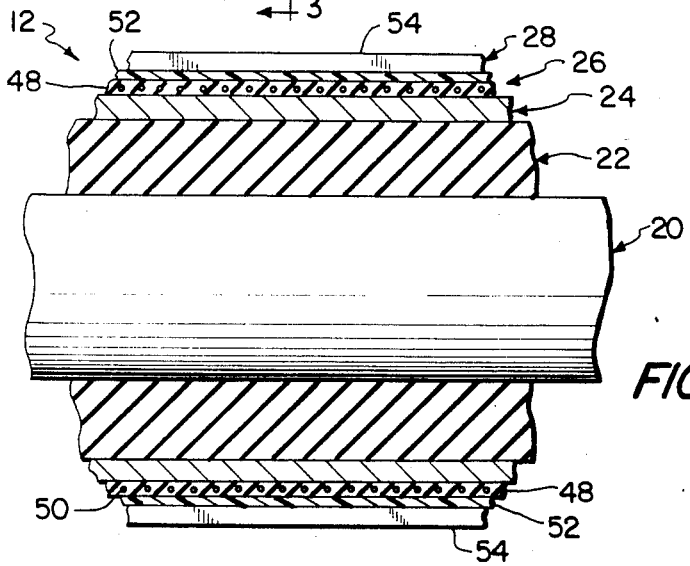
FIG. 3 is a side elevational view in longitudinal section taken along line 3—3 in FIG. 2 of one of the conductor assemblies.

Since each of the three conductor assemblies 12, 14 and 16 are the same, only assembly 12 will be described in detail. As seen in FIGS. 1–3, the conductor 20 is a single strand of metallic conductive material, although a plurality of strands can be used. The insulation layer 22 is cylindrical and is comprised, for example, of rubber.

Figure 4:
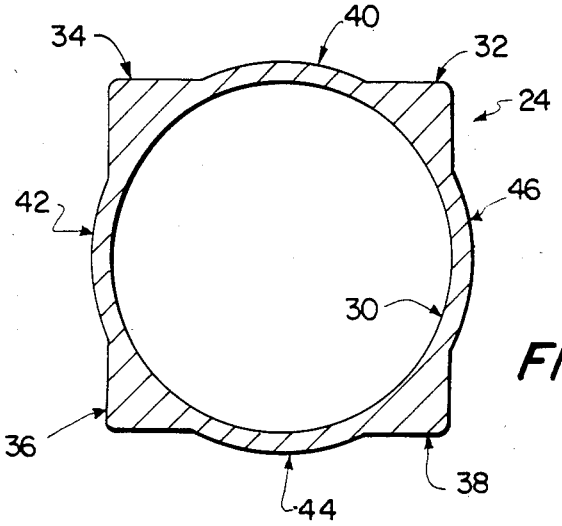
FIG. 4 is an end elevational view in transverse cross-section of the barrier layer shown in FIGS. 1–3.

The barrier layer 24, as seen by itself in FIG. 4, is advantageously a lead sheath formed as an extrusion with a continuous cross section. This layer can be formed of any other suitable extrudable and chemically resistant material that can resist corrosive gases and fluids found in, for example, oil wells.

The barrier layer 24 has a circular interior 30 and an exterior comprised of four right angle corners 32, 34, 36 and 38 which are arranged in a substantially square array and four convex areas 40, 42, 44, and 46. These convex areas interconnect adjacent pairs of the right angle corners to form the continuous, closed cross section of the barrier layer. The convex areas have outer surfaces which have substantially the same center point as the circular interior 30 of the cross section and are arcs of a circle extending about 55°. The cross section is thinnest at these convex areas, this thickness being uniform and a portion of a cylinder.

The barrier layer 24 substantially fills the cavity between the insulation 22 and the inside of the compression-resistant layer 28, except for the filler layer 26, due to its unique shape. In this regard, it is advantageous to avoid using a completely square cross section because this adds significant amounts of material and therefore weight to the barrier layer. Moreover, it is advantageous to avoid using merely a circular cross section because this does not fill up the space between the insulation and the compression-resistant layer to any great extent and to fill this large, non-uniform space with additional suitable filler material would present considerable manufacturing difficulties.

The filler layer 26 is located in the cavity defined between the outer surface of the barrier layer 24 and the inner surface of the compression-resistant layer 28. This filler layer 26 comprises thermosetting material 48, a fine open-mesh fabric 50 located at or in the outer surface of the thermosetting material, and a layer of polymeric material 52 having a low coefficient of friction.

The thermosetting material 48 is advantageously a high viscosity, flowable material, such as rubber, having a Mooney viscosity measured at 212° F. of about 50–130 before vulcanization. The open-mesh fabric 50 is advantageously woven, braided or knitted of nylon, glass fibers or other suitable materials that are relatively non-extensible and therefore resist outward rupturing of the thermosetting material under decompressive forces. The thermosetting material and open-mesh fabric can be formed as a single tape that is spirally wrapped with a 5–50% overlap around the barrier layer, or the material may be extruded thereover. The polymeric material 52 is advantageously a Mylar or polypropylene spirally wrapped tape having a low coefficient of friction to aid in combining the compression-resistant layer 28 over the wrapped barrier layer, insulation and conductor.

The compression-resistant layer 28, as seen in FIGS. 1–3, comprises a pair of U-shaped struts 54 and 56 which are formed of metal and provide resistance to transverse compression forces acting on the connector assembly. These struts have spaced partial slots 58 formed transversely therein to increase their ability to bend along long radiuses. When combined over the filler layer 26, as seen in FIG. 6, the pair of struts 54 and 56 have a substantially square cross section with a pair of slots 60 and 62 formed therebetween at the top and bottom.

Construction of the Cable

In constructing the cable 10 in accordance with the invention, each individual conductor 20 is provided with an insulation layer 22 and then the barrier layer 24 is extruded over the insulation on each to form a subassembly comprising the conductor, insulation layer and barrier layer, as seen best in FIG. 1. Then, the filler layer 26 comprising the uncured thermosetting material 48, open-mesh fabric 50 and polymeric tape 52 is helically wrapped around each of the subassemblies so formed.

Next, three sets of struts 54 and 56 are installed over each of the three filler layers to form the three conductor assemblies 12, 14 and 16 shown in FIGS. 1, 2 and 5. Then, these three conductor assemblies are aligned in a side-by-side relationship and passed through a conventional armoring machine which applies the armor tape 18 thereon to form the cable 10 with a rectangular cross section as seen in FIGS. 1 and 5. If desired, to aid in attaching the cable 10 to a cylindrical pipe, the cable 10 can be passed through a set of curved forming rollers to modify the rectangular cross section shown in FIG. 5 to a curved cross section shown in FIG. 6.

Following this, the cable is stored on reels and is placed in an oven for curing at about 250° F. for about 48 hours. During this curing, the insulation expands outwardly and somewhat outwardly deforms the barrier layer. This outward deformation, as well as thermal expansion, causes the thermosetting material to move outwardly and to flow through the open-mesh fabric and through the overlaps of the polymeric tape, thereby filling various voids inside the compression-resistant layer 28 as well as the slots 60 and 62. Advantageously, the curing temperature is essentially the same as that experienced by the cable during use, so that thermal expansion during use will not destroy the cable.

Thus, by utilizing the impervious barrier layer 24, the underlying insulation layer 22 is protected from corrosive chemicals; by utilizing the closed cross section barrier layer 24 in combination with the substantially square compression-resistant layer 28 the cable resists transverse compression forces; and by utilizing the open-mesh fabric 50 in combination with the thermosetting material 48, the cable resists explosive decompression upon removal from a well in the event high pressure gas was absorbed by the insulation.

While one advantageous embodiment has been chosen to illustrate the invention, it will be understood by those skilled in the art that various changes and modifications can be made therein without departing from the scope of the invention as defined in the appended claims.

What is claimed is:

1. An electrical cable, the combination comprising:
an electrical conductor;
an insulation layer enclosing said conductor;
a barrier layer enclosing said insulation layer;
said barrier layer having a continuous cross section including an interior which is substantially circular and an exterior which includes four right angle corners oriented in a square array and four convex areas, each convex area interconnecting a pair of adjacent right angle corners;
a filler layer enclosing said barrier layer; and
a compression-resistant layer enclosing said filler layer and having a substantially square cross section.

2. A cable according to claim 1, wherein
said insulation layer is substantially cylindrical.

3. A cable according to claim 1, wherein
said barrier layer is metallic.

4. A cable according to claim 1, wherein said barrier layer is formed of lead.

5. A cable according to claim 1, wherein said barrier layer cross section is thinnest at said convex areas.

6. A cable according to claim 1, wherein said convex areas each define an arc of a circle having a common center point with said circular interior of said cross section.

7. A cable according to claim 1, wherein said filler layer comprises a cured thermosetting material.

8. A cable according to claim 1, wherein said filler layer comprises an open-mesh fabric.

9. A cable according to claim 1, wherein said filler layer comprises a polymeric layer.

10. A cable according to claim 1, wherein said filler layer comprises a cured thermosetting material, and an open-mesh fabric.

11. A cable according to claim 1, wherein said compression-resistant layer comprises a pair of substantially U-shaped struts.

12. An armored electrical cable, the combination comprising:

a plurality of conductor assemblies in a sid-by-side relationship, each conductor assembly comprising an electrical conductor, an insulation layer enclosing said conductor, a barrier layer enclosing said insulation layer, said barrier layer having a continuous cross section including an interior which is substantially circular and an exterior which includes four right angle corners oriented in a square array and four convex areas, each convex area interconnecting a pair of adjacent right angle corners, a filler layer enclosing said barrier layer, and a compression-resistant layer enclosing said filler layer and having a substantially square cross section, and an armor layer enclosing said plurality of conductor assemblies.

13. A cable according to claim 12, wherein said cable has a substantially rectangular cross section.

14. A cable according to claim 12, wherein said cable has a curved cross section.

15. A cable according to claim 12, wherein said barrier layer in each of said conductor assemblies is formed of lead.

16. An electrical cable, the combination comprising:

an electrical conductor;

an insulation layer enclosing said conductor; and a barrier layer enclosing said insulation layer;

said barrier layer having a continuous cross section including an interior which is substantially circular and an exterior which includes four right angle corners oriented in a square array and four convex areas, each convex area interconnecting a pair of adjacent right angle corners.

17. A cable according to claim 16, wherein said barrier layer is metallic.

18. A cable according to claim 16, wherein said barrier layer is formed of lead.

19. A cable according to claim 16, wherein said barrier layer cross section is thinnest at said convex areas.

20. A cable according to claim 16, wherein said convex areas each define an arc of a circle having a common center point with said circular interior of said cross section.

21. An electrical cable, the combination comprising:

an electrical conductor;

an insulation layer enclosing said conductor; and a barrier layer completely enclosing said insulation layer;

said barrier layer having a cross section including an interior which is substantially circular and an exterior which includes four right angle corners oriented in a square array and four convex areas, each convex area interconnecting a pair of adjacent right angle corners.

* * * * *